US009984618B2

(12) United States Patent
Sarrasin

(10) Patent No.: US 9,984,618 B2
(45) Date of Patent: May 29, 2018

(54) ACTIVE MATRIX LIGHT-EMITTING DIODE DISPLAY SCREEN PROVIDED WITH ATTENUATION MEANS

(75) Inventor: Denis Sarrasin, Sassenage (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 464 days.

(21) Appl. No.: 13/879,405

(22) PCT Filed: Sep. 22, 2011

(86) PCT No.: PCT/EP2011/066523
§ 371 (c)(1),
(2), (4) Date: Apr. 14, 2013

(87) PCT Pub. No.: WO2012/049000
PCT Pub. Date: Apr. 19, 2012

(65) Prior Publication Data

US 2013/0208030 A1 Aug. 15, 2013

(30) Foreign Application Priority Data

Oct. 15, 2010 (FR) ..... 10 04065

(51) Int. Cl.
*G09G 3/30* (2006.01)
*G09G 3/3233* (2016.01)
(Continued)

(52) U.S. Cl.
CPC ..... *G09G 3/3233* (2013.01); *G09G 3/2081* (2013.01); *G09G 3/3208* (2013.01);
(Continued)

(58) Field of Classification Search
USPC ..... 345/36, 45, 76–81
See application file for complete search history.

(56) References Cited

U.S. PATENT DOCUMENTS

2002/0196215 A1* 12/2002 Tsuchida et al. ..... 345/82
2004/0041525 A1* 3/2004 Park et al. ..... 315/169.3
(Continued)

FOREIGN PATENT DOCUMENTS

EP 1061497 A1 12/2000
EP 1562168 A2 8/2005
WO 2004/051616 A2 6/2004

*Primary Examiner* — Sanghyuk Park
(74) *Attorney, Agent, or Firm* — Baker & Hostetler LLP

(57) ABSTRACT

An active matrix light-emitting diode display screens, and in particular those with organic diodes is discussed. The display screen includes an active matrix of pixels, each pixel including a light-emitting diode, a control MOS transistor for applying a variable voltage or current to the anode of the diode, a selection transistor for applying a variable analog voltage representing a relative level of luminance of the pixel in the image, to the gate of the transistor, during a write phase of this pixel, a storage capacitor for maintaining this voltage on the gate of the transistor outside the write phase. A mean luminance attenuation circuit including a switch for periodically connecting one of the electrodes of the diode, preferably the cathode, to one or other of two fixed potentials, and a switch control circuit for switching with a variable duty cycle according to the desired attenuation.

13 Claims, 3 Drawing Sheets

(51) Int. Cl.
*G09G 3/20* (2006.01)
*G09G 3/3208* (2016.01)

(52) U.S. Cl.
CPC ..... *G09G 2300/0866* (2013.01); *G09G 2320/0242* (2013.01); *G09G 2320/0626* (2013.01)

(56) References Cited

U.S. PATENT DOCUMENTS

| | | | | |
|---|---|---|---|---|
| 2005/0168417 | A1* | 8/2005 | Ha et al. | 345/76 |
| 2006/0092146 | A1* | 5/2006 | Johnson et al. | 345/204 |
| 2006/0164345 | A1 | 7/2006 | Sarma et al. | |
| 2008/0284693 | A1* | 11/2008 | Sarma et al. | 345/77 |
| 2010/0066723 | A1* | 3/2010 | Nam et al. | 345/213 |
| 2010/0149140 | A1* | 6/2010 | Nakamura et al. | 345/204 |

* cited by examiner

ACTIVE MATRIX LIGHT-EMITTING DIODE DISPLAY SCREEN PROVIDED WITH ATTENUATION MEANS

CROSS-REFERENCE TO RELATED APPLICATIONS

This application is a National Stage of International patent application PCT/EP2011/066523, filed on Sep. 22, 2011, which claims priority to foreign French patent application No. FR 1004065, filed on Oct. 15, 2010, the disclosures of which are incorporated by reference in their entirety.

FIELD OF THE INVENTION

The invention relates to active matrix light-emitting diode display screens, and in particular those with organic diodes (AM-OLED).

BACKGROUND

These screens have significant advantages compared with liquid crystal displays (LCDs) as they emit light directly instead of modulating the transmission of light from a source outside the matrix. Therefore they do not need a light source. In addition, they have better contrast, they can be constructed on flexible substrates and they can provide images with excellent colorimetric qualities.

In certain cases, it is desirable to be able to display a given image with a variable average brightness without affecting the color rendition of the image. This is notably the case when it is desired that the screen can be watched comfortably in all kinds of outside light environment conditions. For example, in the sun, the screen must be very bright, otherwise nothing can be seen, and on the contrary, at night, the screen must not be dazzling to the observer, especially if they have to be able to look both at the screen and the outside night scenery. It is therefore desirable to provide for means of attenuating ('dimming') screen brightness in OLED screens, operable according to the circumstances and notably the outside light environment.

However, adjusting the overall brightness of the screen is not easy because of the characteristics specific to the light emission of OLED diodes. Adjusting the average brightness tends to change the colors of the image, which is to be avoided.

Organic light-emitting diodes are formed by the superposition of layers of organic semiconductor materials between two electrodes, a cathode and an anode, one of which is transparent or semi-transparent and the other is generally reflective in order to obtain an emission in one hemisphere. They emit light when traversed by a current and the greater the current is, the more intense the emission. The current in the diode and the voltage at the diode terminals are linked according to the specific characteristics of the diode. In general, the curve governing this relationship between current and voltage has the appearance shown in FIG. 1. To make it easier to understand, it can be said that they have an inactive zone or zone of high resistivity, for low voltages (less than 2 volts), in which the current is low and produces practically no light emission, then a useful zone of lower resistivity, in which the current increases sharply with the voltage (exponentially), and finally a saturation zone, for higher voltages, in which the current and the light emission increase further with the voltage but less fast than in the useful zone. Three curves are depicted in FIG. 1, for showing that the current, therefore the light emission, further varies substantially with temperature. In the curve example in FIG. 1, it is seen that the screen can benefit from a very wide current dynamic, therefore light emission, if a voltage varying between 2 and 4 or 5 volts is used.

Voltages and currents corresponding to the values of the useful zone are therefore applied individually to each pixel according to the image to be displayed. For this, an elementary circuit, associated with each diode, LED is provided at the intersection of each row and each column of the pixel matrix. This circuit can be used to select the pixel during a write phase for applying a control voltage to it corresponding to the desired light intensity. After the write phase the pixel retains the applied control voltage in memory and continues to emit the corresponding light intensity (except for leaks) up to a following write phase. A display in video mode or in parallel mode is possible. In video mode, all the pixels of a row are written successively then the pixels of the following row successively and so on. In parallel mode, the pixels of a row are written all at once, and then the pixels of the following row are written, and so on.

The basic constitution of a pixel of an OLED diode active matrix with its elementary circuit generally includes:

- at least one control transistor having a source, a drain and a gate, capable of controlling the current flowing in the OLED light-emitting diode,
- the light-emitting diode itself, having an anode and a cathode, one of the electrodes being connected to the source or to the drain of the control transistor, the other electrode being common to a plurality of pixels in the matrix,
- means for driving the control transistor according to the information to be displayed by the pixel.

Various configurations are possible, the control transistor notably being able to be of the NMOS or PMOS type, and the electrode common to a plurality of pixels being able to be connected between the control transistor and a low power supply potential or between the control transistor and a high power supply potential.

FIG. 2 depicts an example of pixel configuration of an organic diode active matrix. The pixel includes:

- the OLED light-emitting diode corresponding to this pixel, of which the cathode is connected to a cathode potential Vk,
- an NMOS control transistor $Q_c$ of which the source is connected to the anode of the OLED diode and of which the drain is connected to a power supply voltage source Vdd which can supply the current necessary for light emission;
- a selection transistor $Q_s$ that is used to enable the application of a gate voltage Vdat to the gate of the control transistor; this voltage Vdat is an analog voltage whose value varies according to the light emission desired for the pixel; it is applied to the drain of the transistor $Q_s$ by a column driver $C_j$ common to all the pixels of a same column of rank j of the matrix; the column driver receives and transmits a voltage Vdat for a given pixel when this pixel is selected by the selection transistor $Q_s$; the source of the selection transistor $Q_s$ is connected to the gate of the control transistor $Q_c$; the gate of the selection transistor $Q_s$ is connected to a row driver $L_i$ common to all the pixels of a same row of rank i of the matrix;
- a storage capacitor $C_{st}$ connected between the drain and the gate of the control transistor; this capacitor maintains the voltage applied to the gate of the transistor $Q_c$ throughout an image frame, after a voltage Vdat has been applied to this gate at the time the pixel is written.

The storage capacitor is not always needed, notably if the parasitic capacitance of the transistor (between gate and source-drain) is sufficiently high to be able fulfill this role of maintaining the voltage for the duration of a frame.

The operation of a matrix using this elementary pixel circuit is as follows: the pixels of the first row are written by making the selection transistors of this row conductors; then, in video mode, the individual voltages Vdat to be applied to the successive pixels of the row are applied successively to the various columns of the matrix; in parallel mode, the voltages would be applied simultaneously on all the columns; in both cases, the voltage Vdat assigned to one pixel is transferred over to the gate of the pixel's control transistor and to the associated storage capacitor $C_{st}$, which generates a light emission; the light intensity depends on the voltage Vdat, since this controls the flow of current in the transistor and in the OLED diode. After writing in a pixel, the storage capacitor $C_{st}$ maintains the potential Vdat on the gate, up to a following write phase. Accordingly, the pixel maintains the light emission corresponding to this voltage Vdat until the following write, i.e. for the duration of an image frame.

An image frame includes the successive writing of all the pixels of all the rows of the matrix. In addition, in video mode, there are idle times ('row blanking') at the beginning and end of writing each row, and at the beginning and end of writing each frame ('frame blanking').

It will be understood that if a same image is to be displayed very brightly (for daytime ambient conditions) or with low brightness (for nighttime ambient conditions), all the voltages Vdat can be modified for adapting the image to the ambient conditions and displaying darker images in the second case thanks to much lower voltages. But first this requires an extension of the input dynamic over several decades and secondly, given the highly non-linear form of the emission characteristics of OLEDs (FIG. 1), it is very difficult to maintain the same image quality for both cases, in particular in terms of color retention, especially if it must be done for a plurality of levels of mean luminance.

The brightness of the screen may also be modified by acting on the value of the cathode voltage Vk without modifying the analog voltages Vdat representing the image and without modifying the voltage Vdd of the power supply source: raising Vk clearly means that there is an overall downward movement of the characteristic in FIG. 1. But here again, as the foot of the curve is approached, the more the color characteristics of the image change.

Patent publication US2006/0164345 further proposed a pixel circuit scheme tending to apply the voltage Vk to the cathode of the OLED diode for a part of a cycle and to interrupt this application for the rest of the time. An attenuation transistor, alternately turned on and blocked by variable duty cycle pulses ("Pulse Width Modulation" PWM) on its gate, is placed in series between the cathode of the diode and the cathode reference at the potential Vk. According to the switching duty cycle, the average brightness of the screen can be varied without modifying the voltage Vdat pattern to be applied to the matrix.

This scheme and other schemes of this publication therefore act through temporary interruption of the current in the OLED diode, by removing the negative power supply or the positive power supply for a variable duration.

However, when the negative voltage Vk ceases to be applied, it is found that the current in the OLED diode is not interrupted immediately as would be desired. This results from parasitic capacitances that impede the instantaneous removal of the voltage present at the diode terminals. The current present in the LED while the negative power supply Vk is applied tends to persist for some time, notably because the capacitance existing naturally between the electrodes of the diode maintains a voltage at the terminals thereof; this capacitance is gradually discharged due to the current flowing through the diode, and the current is gradually reduced, gradually reducing the emission of light. This reduction depends largely on the current that exists in the diode just before switching. It therefore varies from pixel to pixel. Because of this, the resulting average reduction in intensity of emission in one pixel for a given duty cycle, therefore depends on the initial state of the pixel. It does not lead to a uniform reduction in brightness and the image is distorted, notably in terms of colorimetry, when it is wished to attenuate its average brightness.

It may be added that for picture elements of low brightness, the discharge of the voltage at the diode terminals is particularly slow when the power supply via Vk is interrupted, so that for low duty cycles there may, in fact, be no brightness reduction for these pixels.

It was further proposed in patent application EP1 061 497 to reduce brightness by acting on the cathode voltage, but the device described does not enable average attenuations to be established, or requires that the cathodes of the OLEDs are grouped by rows independent of the cathodes of the other rows.

SUMMARY OF THE INVENTION

This is why the present invention provides a method for controlling the luminance of a display screen including an active matrix of pixels, each pixel including a light-emitting diode having two electrodes, an anode and a cathode respectively, one of which is common to all the pixels of the matrix, at least one control MOS transistor capable of controlling the current flowing in the diode according to information on luminance to be displayed, and in which the image is written from a video signal row by row in the course of a frame duration, a duration termed frame blanking being provided between the writing of the last row of a first frame and the writing of the first row of a following frame, and a duration termed row blanking being provided between the writing of a row and the writing of a following row, characterized in that, for displaying a given image with a desired attenuation of mean luminance, a first fixed potential is imposed periodically on the common electrode of the light-emitting diodes enabling light emission by the diodes alternately with a second fixed potential blocking light emission, with a variable duty cycle according to the desired attenuation, and in that switching of the common electrode potential is performed for certain desired attenuations at instants during the row blanking times.

Furthermore, correspondingly the invention provides a display screen including an active matrix of pixels, each pixel including a light-emitting diode having two electrodes, an anode and a cathode respectively, one of which is common to all the pixels of the matrix, at least one control MOS transistor capable of controlling the current flowing in the diode according to information on luminance to be displayed, and in which the image is written from a video signal row by row in the course of a frame duration, a duration termed frame blanking being provided between the writing of the last row of a first frame and the writing of the first row of a following frame, and a duration termed row blanking being provided between the writing of a row and the writing of a following row, characterized in that it includes a mean luminance attenuation circuit including a switch for periodically connecting the common electrode of the diodes alternately to a first fixed potential enabling light emission by the diode and a second fixed potential blocking this emission, and a switch control circuit for switching with a variable duty cycle according to the desired attenuation, and in that the switch control circuit includes means for switching the potential of the common electrode at instants during the row blanking times.

Preferably a selection transistor is provided in the pixel for applying a variable analog voltage representing the information on luminance to be displayed, to the gate of the control transistor, during a pixel write phase.

The pixel preferably further includes a storage capacitor for maintaining the analog voltage on the gate of the transistor outside the write phase.

The switching of the potential between the two fixed values is performed exclusively outside the write phases of the matrix pixels.

The switching control circuit preferably further includes means for also switching potential during frame blanking times.

For this switching, the switch control circuit is controlled according to clock signals that ensure the writing of an image onto the matrix pixels. This circuit may consist of a general controller used to perform the write phases and having a specific output programmed for supplying the switching control signal which is a variable duty cycle signal according to the desired attenuation.

Preferably also, all the pixels of the matrix are addressed in the course of a same frame under the same conditions of polarization, which means that at the time of a frame all the pixels are connected to the same fixed potential while information is written to the pixel. Accordingly, in the course of a frame there may be switching between the two fixed potentials when this switching occurs during a blanking time, but at the time of the effective write phase the pixels are all connected to the same fixed potential, whether the first or the second.

BRIEF DESCRIPTION OF THE DRAWINGS

Other features and advantages of the invention will appear on reading the detailed description which follows and which is made with reference to the accompanying drawings in which.

DETAILED DESCRIPTION

Figure 2:
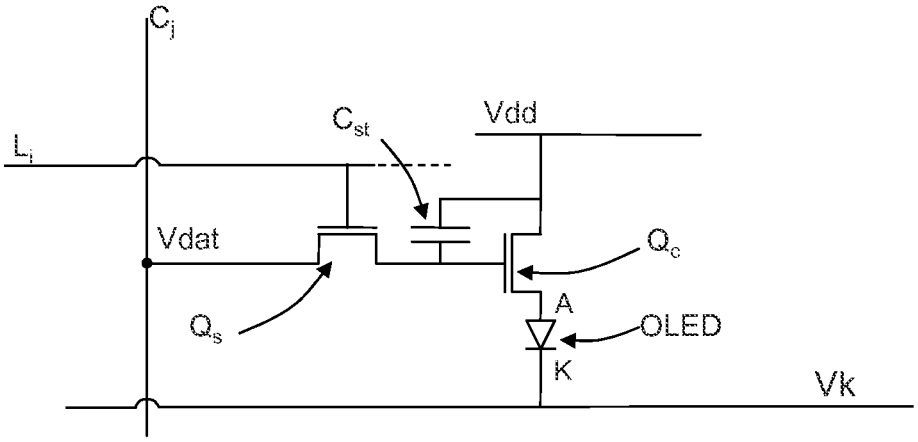
FIG. 2 shows a conventional elementary pixel circuit of an OLED diode active matrix.
Figure 3:
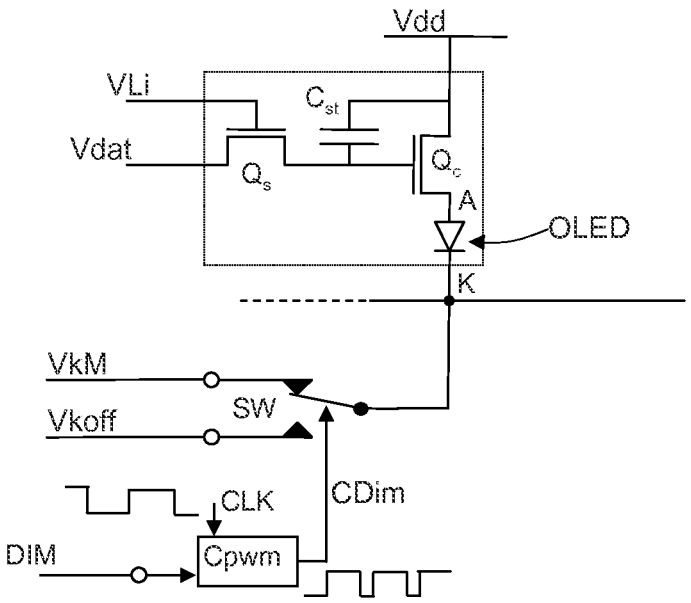
FIG. 3 shows the general principle of the invention.

FIG. 3 partly repeats elements from FIG. 2 which have the same functions and will be not be described again.

In all that follows, it will be assumed that the OLED diode cathodes are common to all the pixels of the matrix and that the control transistor is an NMOS. However, there could also be a configuration in which it is the anodes which are common. There could also be a control transistor of the PMOS type.

The OLED diode cathodes of the matrix are therefore here all connected together (they form a common electrode under the whole plane of the matrix) and they are connected to an output terminal of a switch SW with two input terminals. The inputs of the switch SW are connected to two different fixed potentials VkM and Vkoff.

Figure 1:
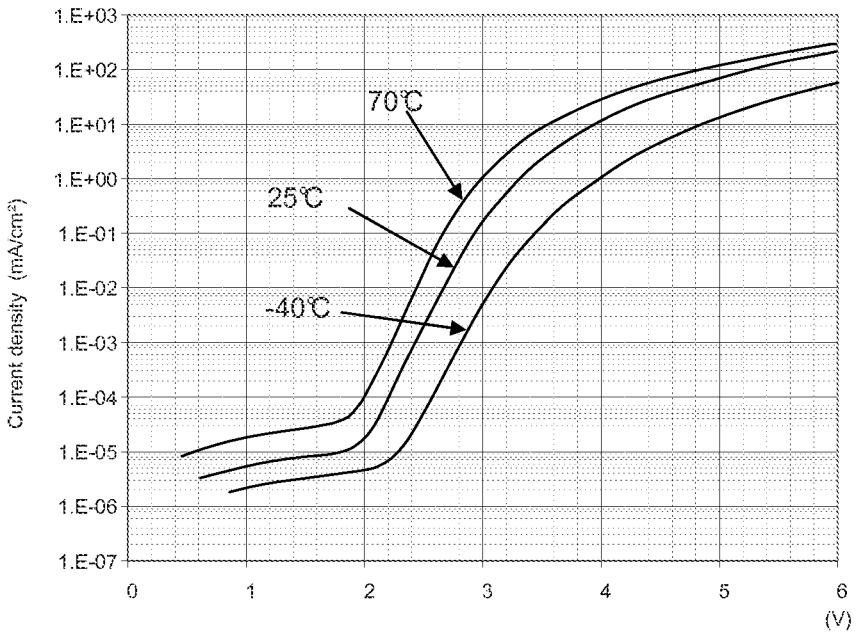
FIG. 1 shows a typical current response curve as a function of the voltage applied to an OLED diode.

The potential VkM is a potential equivalent to the potential Vk that would be applied in the circuit of FIG. 2; assuming that the image signal can take coded luminance values Lmin to Lmax, the potential VkM is chosen so that the screen supplies a strong illumination for the pixels receiving a voltage Vdat corresponding to the maximum luminance Lmax, in other words, the potential VkM is chosen so that the OLED diode always operates in the useful part of the curve of FIG. 1; for example, for a diode having the characteristic of the curve shown in FIG. 1, VkM is such that the voltage at the terminals of the diode is about 4 to 5 volts when the voltage Vdat applied to the pixel is that which corresponds to the maximum luminance of the range in which the video signal is coded.

The potential Vkoff is a more positive potential than the potential VkM. It tends to instantaneously reduce the voltage and the current in the OLED diode whatever the voltage Vdat applied to the pixel, and thus places the diode at the bottom of the current-voltage characteristic. The self-capacitance of the OLED diode can be discharged in the terminal at the potential Vkoff, without maintaining a current in the diode. Thus, for a same voltage Vdd and for a same pixel voltage Vdat, the diode passes instantly into a zone where it no longer emits light without its self-capacitance tending to cause a light emission residue which remained in the prior art mentioned above.

Accordingly, when the switch applies VkM to the cathodes, the screen operates normally, but when it applies Vkoff the screen no longer emits any more light whatever the level of voltage Vdat applied to the pixels.

The switch SW is controlled by a periodic signal Cdim from a pulse width modulation circuit Cpwm. This circuit establishes periodic switching between the two inputs of the switch with a duty cycle that may be controlled by a DIM control. The DIM control modifies the duty cycle according to the attenuation ('dimming') desired for the average brightness of the screen. The duty cycle may vary between 1 (no attenuation, the switch SW applies VkM continuously to the OLED diode cathodes) and 0 (maximum attenuation, the switch SW applies Vkoff continuously to the OLED diode cathodes); for an intermediate value, the duty cycle represents the ratio between the time when the switch applies Vkoff and the total time of one complete period where VkM then Vkoff are successively applied.

The frequency (clock CLK) of switching is at least 50 Hz so that persistence of vision prevents the transition from VkM to Vkoff being visible. The mean luminance of the screen is then proportional to the duty cycle of the periodic switching. The clock CLK defining the switching period may be a clock representing the frame scan period of the display.

According to the invention, it is preferably further provided that switching from the VkM level to the Vkoff level and vice versa takes place at instants that are not during a phase of writing information in a pixel. The write phase of a pixel is that during which the selection transistor $Q_s$ is made a conductor and a potential Vdat is applied on the storage capacitor $C_{st}$ through this transistor. Switching by the switch SW is therefore performed only at instants when the storage capacitor $C_{st}$ is isolated, either because the selection transistor $Q_s$ is isolated, or because the column $C_j$ is at high impedance between two applications of signal Vdat.

In addition, for certain desired attenuations, it is provided that switching occurs during the row blanking times of the video signal applied to the screen.

Figure 4:
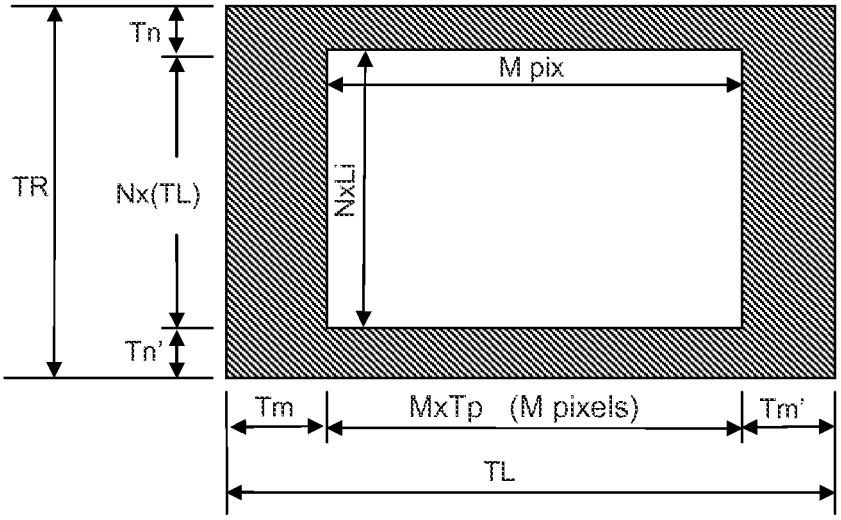
FIG. 4 symbolically shows the distribution of the row and frame scan times and the row and frame blanking times in a screen receiving a video signal.

FIG. 4 symbolically shows the general principles of scanning a screen for displaying an image in the case where this image arrives in the form of a standard video signal. The image to be displayed contains N rows and M visible pixels in each row. The video signal for one complete image frame occupies a duration corresponding both to an effective write time and to the dead times or row and frame blanking times. More specifically, the effective write time in the frame is the time of writing N×M pixels displayed but the overall duration of the frame including the blanking times is equivalent to the virtual time that would be needed for displaying (n+N+n') rows of (m+M+m') pixels each. The numbers n and n' represent the numbers of dummy rows of start and end of frame blanking times. The numbers m and m' represent numbers of dummy pixels of start and end of row blanking times.

The video signal thus contains a succession of successive voltage levels which breaks down over time into:

- start of frame blanking, of which the duration Tn represents n times the standard duration of writing a row of pixels; over this duration Tn the pixels of the matrix do not receive voltage Vdat, since their selection transistors $Q_s$ are blocked;
- then, for each successive row from 1 to N of the pixel matrix:
  - start of row blanking, of which the duration Tm represents m times the duration Tp of a pixel write phase; over this duration, the pixels of the matrix do not receive voltage Vdat since the matrix columns are at high impedance and/or the row selection transistors are blocked;
  - active signal of duration M·Tp representing the successive voltage levels corresponding to the luminances to be written successively in the M pixels of the row, the duration being M times the duration Tp of a pixel write phase; over this duration, the pixels receive the voltages Vdat assigned to them, one after the other, which represent the respective luminances;
  - end of row blanking, of which the duration Tm' represents m' times the duration Tp of a pixel write phase; over this duration, as during the start of row blanking, the pixels of the matrix do not receive any new voltage Vdat;
- after the last row of rank N, end of frame blanking, of which the duration Tn' represents n' times the standard duration of writing a row of pixels, i.e. Tn'=n'·(m+M+m')·Tp; over this duration Tn', as for the start of frame, the pixels in the matrix do not receive any voltage Vdat.

It will be noted that here the blanking durations are broken down into a (frame or row) start blanking and end blanking but the end of row or frame blanking duration is extended by a following start of row or frame blanking duration. The sum of these two durations may also be referred to as a row return or frame return duration if it is not desirable to consider them as two separate parts.

The switching control circuit Cpwm is synchronized with the video signal, preferably so that switching does not take place over the durations M·Tp corresponding to the writing of the visible pixels in each row. But it is important to note that writing may be done both while the cathode is at VkM and while the cathode is at Vkoff. However, it is important that all the pixels are written in the course of one frame with the same polarization condition, i.e. all with Vkoff or all with VkM. Indeed, although writing stores a voltage in the capacitor $C_{st}$ of which one terminal is at Vdd, the memory storage on the capacitor is slightly modified according to the polarization conditions of the transistors due to the fact that they are not ideal transistors. For obtaining an undistorted display one part of the rows should therefore not be written with the cathode at VkM and the other with the cathode at Vkoff.

To give an example of the possibilities of attenuation adjustment, a display screen is considered with the format N=600 rows and M=800 pixels (SVGA standard), receiving a video signal of (n+N+n')=624 rows and (m+M+m')=1024 pixels (VESA transmission standard).

Assuming that n=n'=12 and m=m'=112 a) if the switch SW sets the cathodes at the potential VkM all the time (duty cycle=1), the luminance is 100% of the possible maximum;

b) if the switch switches the cathodes to Vkoff for almost all the row or frame blanking times, i.e. if the cathode changes to Vkoff just after the start of all the row or frame blanking periods and resets them to VkM just before the end of all these blanking periods, the luminance becomes (600/624)×(800/1024) or 75% of its maximum value;

c) if the switch switches the cathodes to Vkoff just before the start of the active signal of duration M·Tp and switches them to VkM just after the end of the active signal for each row, the luminance becomes {1−((600/624)×(800/1024))} or 25% of the maximum;

d) if the switch performs operation c) but in addition sets the cathode potential to Vkoff during the start of row blanking times but not those of the end of row (or vice versa) the luminance changes to 10%;

e) if the cathode potential is at Vkoff the whole time except during frame blankings: luminance at 4%;

f) cathode potential at VkM only during half of a frame start (or end) blanking, at Vkoff the rest of the time: luminance at 1%;

g) cathode potential at VkM during a single row of 800 pixels of the frame blanking, at Vkoff the rest of the time: luminance 1/800 of the maximum luminance;

h) cathode potential at VkM during a single (start or end) blanking of a single row, and at Vkoff the rest of the time: luminance 112/(624×1024), less than 0.2 per thousand of the maximum luminance.

There is therefore a very wide range of possibilities for luminance attenuation, and in particular average attenuations obtained by switching during all or part of the row blanking durations. If attenuations with a more precisely defined value are wanted, other than the aforementioned values, the number of rows or fractions of rows involved in the transition of the potential to VkM may also be adjusted more precisely.

By reducing the luminance in this way, the contrast of the initial image is fully preserved.

Figure 5:
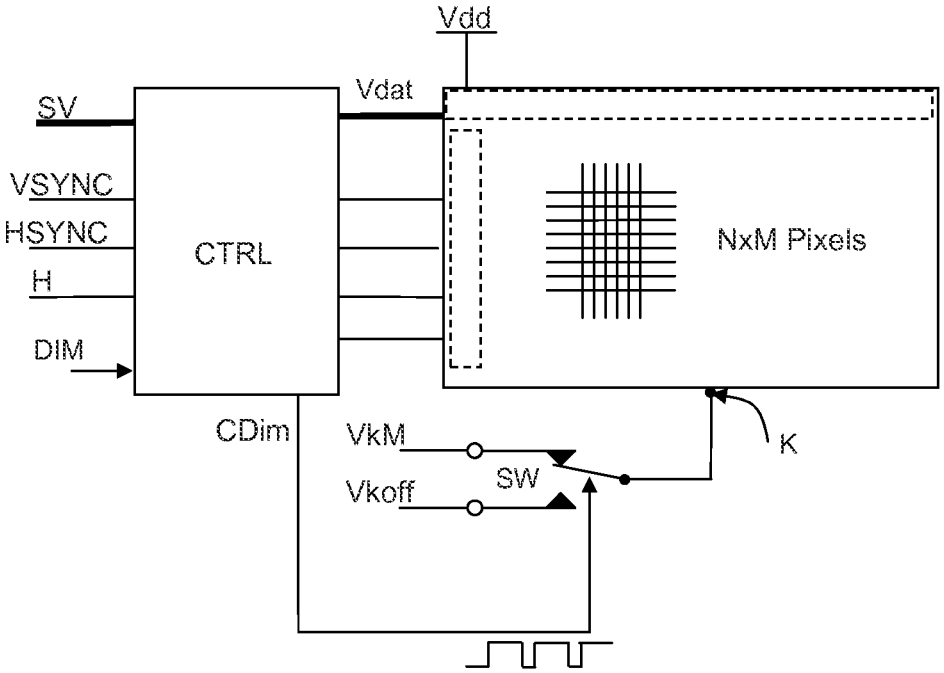
FIG. 5 shows a display screen according to the invention.

FIG. 5 shows the overall schematic diagram of an active matrix organic light-emitting diode display screen according to the invention. In this figure, it is simply considered that writing pixels is handled by a controller or sequencer CTRL; the controller receives the synchronization signals (pixel clock H, vertical VSYNC and horizontal HSYNC synchronization logic signals) of the video signal and the video signal SV itself, in digital or analog form. The controller controls the row and column address registers of the matrix for performing sequential writing row by row in the frame and pixel by pixel in each row. It is this that produces the voltages Vdat to be applied to the pixels according to the video signal received.

In this case, it is simplest to provide that it is the controller CTRL which in addition constitutes the Cpwm circuit and which therefore establishes the variable duty cycle signal Cdim according to an external DIM control, specifying the desired attenuation. The external control may be manual or automatic according to the light environment. The signal Cdim is temporally set with respect to the synchronization signals according to the explanations given above for preventing under all circumstances switching from occurring during the write periods of visible pixels and for ensuring that during the active signal time M·Tp of a frame the same cathode potential VkM or Vkoff is applied to all the pixels according to the desired attenuation level.

The controller may prepare, from the explanations given above and notably from the examples of attenuation a) to i), a sequencing table of the desired switching instants according to the desired attenuation. This table may form part of a read-only memory or a programmable memory forming part of the controller or associated with the controller. In another embodiment, the controller prepares the sequence from a logic based on state machines.

The invention claimed is:

1. A method for controlling a luminance of a display screen including an active matrix of pixels, each pixel in the active matrix of pixels including a light-emitting diode having two electrodes, an anode and a cathode respectively, one of said anode and said cathode being a common electrode to all the pixels of the active matrix of pixels, and at least one control Metal Oxide Semiconductor (MOS) transistor configured to control current flowing in the light-emitting diode according to information on luminance to be displayed, the method comprising:

writing an image from a video signal row by row over a frame duration, a frame blanking duration being provided between a writing of a last row of a first frame and a writing of a first row of a following frame, and a row blanking duration being provided between a writing of a row and a writing of a following row, wherein, for displaying a given image with a desired attenuation of mean luminance, a first fixed potential is imposed periodically on the common electrode of the light-emitting diodes enabling light emission by the light-emitting diodes in the active matrix of pixels alternately with a second fixed potential blocking light emission, with a variable duty cycle according to the desired attenuation, and using a switch for actively switching a potential of the common electrode between the first fixed potential and the second fixed potential for certain desired attenuations at instants during row blanking durations.

2. The method as claimed in claim 1, wherein during the writing of the pixels of the active matrix in the course of a same frame, the first fixed potential is the same for all the pixels, and the second fixed potential is the same for all the pixels.

3. A display screen comprising:

an active matrix of pixels, each pixel in the active matrix of pixels including a light-emitting diode having two electrodes, an anode and a cathode respectively, one of said anode and said cathode being a common electrode to all the pixels of the active matrix of pixels, at least one control Metal Oxide Semiconductor (MOS) transistor configured to control a current flowing in the light-emitting diode according to information on luminance to be displayed, and in said display screen, an image is written from a video signal row by row over a frame duration, a frame blanking duration being provided between a writing of a last row of a first frame and a writing of a first row of a following frame, and a row blanking duration being provided between a writing of a row and a writing of a following row, a mean luminance attenuation circuit including a switch for periodically connecting the common electrode of the light-emitting diodes alternately to a first fixed potential enabling light emission by the light-emitting diodes and a second fixed potential blocking the light emission, and a switch control circuit configured to switch with a variable duty cycle according to a desired attenuation, and the switch control circuit includes means for switching actively a potential of the common electrode between the first fixed potential and the second fixed potential at instants during row blanking durations.

4. The display screen as claimed in claim 3, wherein each said pixel comprises a selection transistor for applying a variable analog voltage representing the information on luminance to be displayed, to a gate of the control MOS transistor, during a pixel write phase.

5. The display screen as claimed in claim 4, wherein each said pixel includes a storage capacitor for maintaining the variable analog voltage on the gate of the control MOS transistor outside the pixel write phase.

6. The display screen as claimed in claim 4, wherein the light-emitting diodes are organic light-emitting diodes.

7. The display screen as claimed in claim 4, wherein the switch control circuit further includes means for switching potential during frame blankings.

8. The display screen as claimed in claim 4, wherein each said pixel includes a storage capacitor for maintaining the variable analog voltage on the gate of the control MOS transistor outside the pixel write phase.

9. The display screen as claimed in claim 8, wherein the light-emitting diodes are organic light-emitting diodes.

10. The display screen as claimed in claim 8, wherein the switch control circuit further includes means for switching potential during frame blankings.

11. The display screen as claimed in claim 3, wherein the light-emitting diodes are organic light-emitting diodes.

12. The display screen as claimed in 11, wherein the switch control circuit further includes means for switching potential during frame blankings.

13. The display screen as claimed in claim 3, wherein the switch control circuit further includes means for switching potential during frame blankings.

* * * * *